US008959847B2

(12) United States Patent
Recker et al.

(10) Patent No.: US 8,959,847 B2
(45) Date of Patent: Feb. 24, 2015

(54) METHOD AND APPARATUS FOR ATTACHING TEMPORARY LIFTING MEMBERS TO AN EXISTING LIFTING ANCHOR

(71) Applicant: Meadow Burke LLC, Tampa, FL (US)

(72) Inventors: Michael J. Recker, Lithia, FL (US); Randy Lance Osborne, Valrico, FL (US); James Zachery Petersen, Riverview, FL (US)

(73) Assignee: Meadow Burke, Tampa, FL (US)

( * ) Notice: Subject to any disclaimer, the term of this patent is extended or adjusted under 35 U.S.C. 154(b) by 0 days.

(21) Appl. No.: 13/923,139

(22) Filed: Jun. 20, 2013

(65) Prior Publication Data

US 2013/0340357 A1 Dec. 26, 2013

Related U.S. Application Data

(60) Provisional application No. 61/661,947, filed on Jun. 20, 2012.

(51) Int. Cl.

| | |
|---|---|
| ***E02D 35/00*** | (2006.01) |
| ***E04G 21/14*** | (2006.01) |
| ***E04H 12/34*** | (2006.01) |
| ***B66C 1/66*** | (2006.01) |

(52) U.S. Cl.
CPC ..... *B66C 1/666* (2013.01)
USPC ..... 52/125.5

(58) Field of Classification Search
USPC ..... 52/125.1, 125.2, 125.3, 125.4, 125.5, 52/125.6, 122.1, 123.1, 124.1, 124.2; 294/215; 249/35, 63, 97, 142, 177, 249/184, 186, 190, 217; 425/111
See application file for complete search history.

(56) References Cited

U.S. PATENT DOCUMENTS

| | | | | |
|---|---|---|---|---|
| 2,099,116 | A | | 11/1937 | Kalmach |
| 3,798,856 | A | | 3/1974 | Gloskowski |
| 4,083,156 | A | | 4/1978 | Tye |
| 4,173,856 | A | | 11/1979 | Fricker |
| 4,367,892 | A | * | 1/1983 | Holt ..... 294/89 |
| 4,383,674 | A | | 5/1983 | Fricker |
| 4,437,642 | A | | 3/1984 | Holt |
| 4,615,554 | A | | 10/1986 | Schilla et al. |
| 4,634,164 | A | | 1/1987 | Fricker |
| 4,671,554 | A | | 6/1987 | Lancelot |
| 4,700,979 | A | | 10/1987 | Courtois et al. |
| 4,703,595 | A | | 11/1987 | Zipf et al. |
| 4,769,960 | A | | 9/1988 | Zipf et al. |
| 4,807,843 | A | * | 2/1989 | Courtois et al. ..... 249/61 |
| 4,821,994 | A | | 4/1989 | Fricker |
| 4,872,634 | A | | 10/1989 | Gillaspy et al. |
| 5,094,047 | A | | 3/1992 | Kelly et al. |
| 5,155,954 | A | | 10/1992 | Roire |
| 5,535,979 | A | | 7/1996 | Ellis-Callow |

(Continued)

OTHER PUBLICATIONS

U.S. Appl. No. 14/046,730, filed Oct. 4, 2013, Recker et al.

*Primary Examiner* — Mark Wendell
*Assistant Examiner* — Keith Minter
(74) *Attorney, Agent, or Firm* — Sheridan Ross P.C.

(57) ABSTRACT

A hoisting assembly for precast concrete structures is provided. A shackle is joined to an embedded anchor member by a pin or bolt, and the shackle is provided with load bearing members to accommodate various loads in a manner that reduces risk of damage to concrete and provides for a more efficient anchor.

19 Claims, 9 Drawing Sheets

(56) References Cited

U.S. PATENT DOCUMENTS

| | | | | | |
|---|---|---|---|---|---|
| 5,580,115 | A | | 12/1996 | Jessen | |
| 5,651,911 | A | | 7/1997 | Pennypacker | |
| 6,082,700 | A | | 7/2000 | Lancelot, III et al. | |
| 6,092,849 | A | * | 7/2000 | Zambelli et al. | 294/89 |
| 6,142,546 | A | | 11/2000 | Hansort | |
| 6,152,509 | A | | 11/2000 | Hansort | |
| 6,260,900 | B1 | | 7/2001 | Scott | |
| 6,341,452 | B1 | | 1/2002 | Bollinghaus | |
| 6,769,663 | B2 | | 8/2004 | Kelly et al. | |
| 7,905,063 | B2 | | 3/2011 | Kelly | |
| 7,950,190 | B2 | | 5/2011 | Schulze | |
| 8,291,649 | B2 | * | 10/2012 | Kelly | 52/125.5 |
| 2009/0320386 | A1 | | 12/2009 | Mackay | |
| 2012/0073170 | A1 | | 3/2012 | Boltz et al. | |

* cited by examiner

SECTION C

METHOD AND APPARATUS FOR ATTACHING TEMPORARY LIFTING MEMBERS TO AN EXISTING LIFTING ANCHOR

This Non-Provisional Application claims the benefit of priority from U.S. Provisional Patent Application Ser. No. 61/661,947, filed Jun. 20, 2012, the entire disclosure of which is hereby incorporated by reference in its entirety.

FIELD OF THE INVENTION

Embodiments of the present invention are generally related to systems, methods and devices for attaching to lifting anchors. More specifically, embodiments of the present disclosure relate to methods and devices for connecting to a pre-installed insert or anchor bolt associated with a panel or building component.

BACKGROUND OF THE INVENTION

Certain pre-installed members for transmitting force and manipulating panels or structures, such as pre-formed concrete panels, are known in the art. Such devices and systems include, for example, the MeadowBurke® Rapid Lift and Super Lift systems. Prior art systems comprise, for example, a void former or recessing member as shown and described in U.S. Pat. No. 7,905,063 to Kelly, which is hereby incorporated by reference in its entirety. Such devices are generally provided to create a void or point of access in, for example, a concrete panel or wall which generally provides access to an anchor member embedded within the concrete panel for aiding in manipulation and/or movement of the panel. Such manipulation, including lifting and movement of the panel, is facilitated through features and devices as shown and described herein.

One of skill in the art will recognize that when preformed panels and devices of the present disclosure are being manipulated or transmitted between various positions and/or orientations, it is desirable and often critical to establish a secure and safe connection between the panel or device and operational equipment. Additionally, however, it is also necessary to provide a system and device that allows for relative ease of removal of such operational equipment from the panel or device after transport or manipulation of the same is complete. Finally, the device must be designed to prevent damaging the wall panel or structure to avoid the necessity of costly repair and/or replacement.

SUMMARY OF THE INVENTION

Accordingly, it is one aspect of the present invention to provide a lifting system for selectively connecting to concrete members and securely moving or manipulating the members. It is a further aspect of the present invention to provide a system that allows a hook bolt to lock up when lifting in the shear direction without the need for a steel ear on the anchor.

Existing lift systems pose risks of spalling concrete members, particularly at void edges where lifting components contact such edges. Systems and devices of the present disclosure provide a novel lifting mechanism and anchor which reduce concrete spalling, as well as provide for a more efficient anchor capable of being used in thinner panels, at least as compared to the systems of the prior art.

The present disclosure contemplates various systems and methods for providing a void or access feature in a precast concrete structure. For example, U.S. Pat. No. 6,769,663 to Kelly et al., which is hereby incorporated by reference in its entirety, provides one such system suitable for use in connection with the present disclosure.

The oldest and most common void formers employ solid urethane blocks which have an undersurface of a generally arcuate configuration and a slot formed therein and extending into the undersurface for releasable receipt of the anchor to be positioned. The blocks carry protrusions which extend across the slot to releasably engage the anchor. In use, the block is plastically deformed to engage and disengage the anchor. A recent variation of such an anchor wherein the slot is narrowed and defines a passage complimental with the shape of the anchor is seen in U.S. Pat. No. 6,082,700, which is hereby incorporated by reference in its entirety. Earlier examples are found in U.S. Pat. Nos. 4,383,674, 4,821,994, 5,535,979, 5,651,911, and 7,950,190, all of which are hereby incorporated by reference in their entireties.

It is also well known in the art to provide hollow void formers for positioning anchors wherein the void formers have a smooth arcuate undersurface with a slot formed therein for receipt of the anchor. Such void formers, however, are relatively rigid and require some type of separate retaining element to secure the anchor within the slot. An example of such a void former can be found in U.S. Pat. No. 5,094,047, which is also incorporated herein by reference in its entirety.

Aspects of the present disclosure comprise a hollow body having first and second sections hinged together for movement between a closed condition engageable around an anchor received therebetween and an open condition in which the sections are separated to release an anchor received therebetween. A latch is disposed between the sections to releasably secure them in the closed condition. A passage for an anchor is defined between the first and second sections.

A method of embedding a lifting anchor in a concrete structure according to the present disclosure comprises providing a polymeric hollow body having first and second sections hinged together at their upper portions for movement between a closed condition engageable around an anchor received therebetween and an open condition in which the sections are separated to release an anchor received therebetween. The sections define a passage therebetween for receipt and retention of a lifting anchor and are provided with a latch to selectively secure the sections together. In the method, the sections are moved apart to receive the anchor and then moved together to secure the anchor in place. As so conditioned, the void former is cast in place within a concrete structure and, ultimately, removed from the structure by spreading the first and second sections apart and releasing them from the anchor.

A contemplated method of forming the void former comprises providing a mold for injection molding a polymeric material into a body having first and second sections joined by a bridge therebetween and then removing the body from the mold and hinging the sections relative to one another through bending of the bridge, before the polymer is fully cured. In the preferred embodiment, the sections are molded in a condition where the first and second sections are separated and hingedly connected by the bridge. This enables a protruding latching device to be formed between the sections. After removal of the body from the form, and before the polymer has fully cured, the bridge is bent to alter its molecular structure and facilitate it for repeated usage as a hinge.

An object of the present disclosure is to provide a lifting apparatus, system and method for erecting panels. U.S. Pat. No. 6,260,900 to Scott, which is hereby incorporated by reference in its entirety, provides an anchor for use with ring clutches and bail lift clutches. Additionally, U.S. Pat. No.

4,634,164 to Fricker, U.S. Pat. No. 4,173,856 to Fricker, U.S. Pat. No. 4,437,642 to Holt, U.S. Pat. No. 4,700,979 to Courtois and U.S. Pat. No. 4,671,554 to Lancelot disclose lifting means and are hereby incorporated by reference in their entireties.

Various known lifting devices and methods provide a risk of spalling an associated concrete panel, particularly when used improperly. Features of the present disclosure provide for enhanced panel and concrete erection. In one embodiment, a hoisting assembly is provided, the hoisting assembly adapted for erecting a precast concrete element which has at least one anchoring member embedded therein, the assembly comprising an arcuate locking bolt, a hoisting shackle having a hollow toroidal portion, the hollow toroidal portion comprising a slot proximal at least an outer circumference of the hollow toroidal portion for receiving the bolt and a void portion for receiving an upper end of an anchoring member which has been embedded into the concrete structure. The shackle comprises an internal arcuate surface having a radius, the internal arcuate surface comprising a tangent line substantially perpendicular to a tangent of the hollow toroidal portion, and the internal arcuate surface adapted for contacting the anchoring member. The internal arcuate surface is adapted for contacting lateral portions of the anchoring member, thus transferring various non-vertical loads to the anchoring member as opposed to subjecting portions of the panel (e.g. edges of pre-formed voids) to such loads and risking damage to the concrete member.

As will be recognized by one of skill in the art, when a vertical load is applied to a known clutch system and lifting anchor in a substantially vertical manner (i.e. where system components are aligned), a minimal amount of lateral or excess movement will be present. That is, risk of contact between system components and the preformed concrete panel is minimized and spalling of the concrete is unlikely in preferred orientations. However, where loads are applied at various angles, as is common in erection procedures, contact between lifting features and the concrete panel is known to occur with prior art systems. Such contact causes spalling damage to the concrete as well as various undesired point-loading and thus requiring costly repairs. Peripheral wings provided with shackles as shown and described herein provide an internal surface and support structure for contacting an erection anchor when a lateral movement or load is applied to the clutch system. An internal surface of the peripheral wing contacts an exterior surface of the erection anchor upon application of a lateral or non-vertical load, thus maintaining the clutch in a substantially aligned position with respect to a panel or member to be lifted. Maintaining the clutch in such a position prevents contact between various lifting elements and the panel member. Whereas known devices typically result in various forces and points of contact between, for example, an edge region of a pre-formed void, peripheral wings and internal surface area of the shackle center the lifting device and act to direct various loads to the anchor.

Various anchors are contemplated for use in connection with additional system components. In one embodiment, for example, an anchoring member is provided comprising two substantially parallel members for extending into a concrete member, each of the two substantially parallel members connected at a first end to an inwardly converging member, the inwardly converging members connected at a load point, the load point and converging members being generally defined by a U or V-shaped feature. Each of the substantially parallel members, in at least one embodiment, comprise an outwardly oriented portion at a second end of the substantially parallel members, the outwardly oriented members being angled with respect to a longitudinal axis of the substantially parallel members by approximately ninety degrees and wherein the outwardly oriented members extend away from each other.

These and other objects will become more apparent from the accompanying drawings and the following detail description.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

Figure 1:
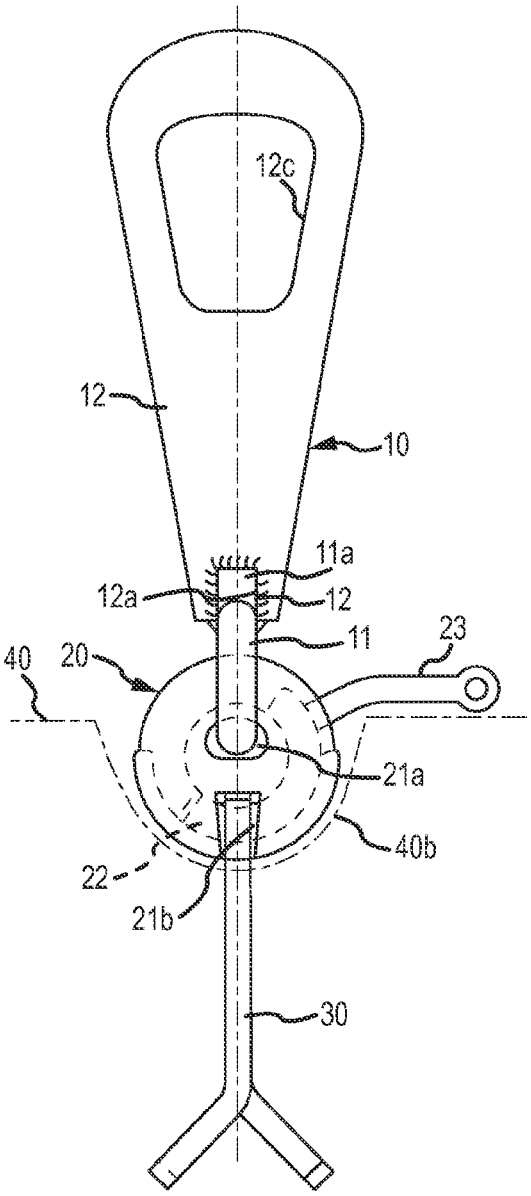
FIG.1 PRIOR ART
FIG. 1 is an elevation view of a hoisting assembly for the attachment of a hoisting harness with a quick-release hoisting shackle to a precast concrete element.
Figure 2:
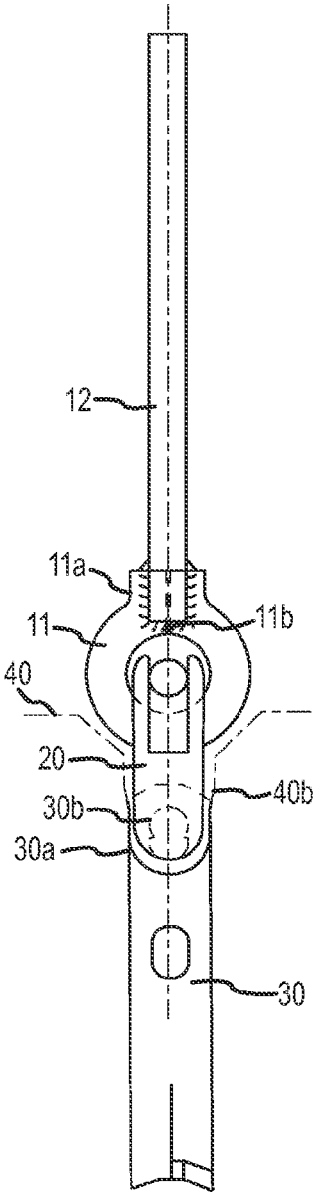
FIG.2 PRIOR ART
FIG. 2 is a side view of the hoisting assembly of FIG. 1.

Referring to FIGS. 1 and 2, a hoisting assembly comprising three principal parts linked together in the manner of a chain: an attachment link 10, a hoisting shackle 20, and an anchoring member 30 is shown. The connection between the attachment link and the hoisting shackle 20 is a permanent one and the connection between the hoisting shackle 20 and the anchoring member 30 is releasable.

The attachment link 10 comprises of a ring part 11 and a link plate 12. The ring part 11 reaches through a central opening 21*a* of the hoisting shackle 20, adjoining the lower extremity of the link plate 12 with a rectangular hub portion 11*a* which engages a central vertical recess 12*a* in the link plate 12. A number of corner welds 12*b* form of strong junction between the ring part 11 and the link plate 12.

The ring part 11 is preferably an annular steel forging. In order to insert the ring part 11 through the central opening 21*a* of the hoisting shackle 20, it is split open along a radial slit 11*b* which bisects its hub portion 11*a*. The split ring part 11 is bent open, so that it can be inserted through the central opening 21*a* of the shackle 20, and the inserted ring part is bent back into its annular shape, whereupon the rejoined halves of its hub portion are inserted into the vertical recess 12*a* of the link plate 12 for the welding operation. Alternatively, a joined cable may be provided for interconnection with the hoisting shackle.

The link plate 12 is a flat metal plate of generally triangular shape with a large eye 12*c* for the insertion of a hook, cable, or other suitable connecting member of a hoisting harness (not shown). The major plane of the link plate 12 is perpendicular to the major plane of the ring part 11. In FIG. 2, it can be seen that the major plane of the link plate 12 is substantially aligned with the major plane of the hoisting shackle 20, when the attachment link 10 is pulled in the direction of the axis of the anchoring member 30.

Figure 3:
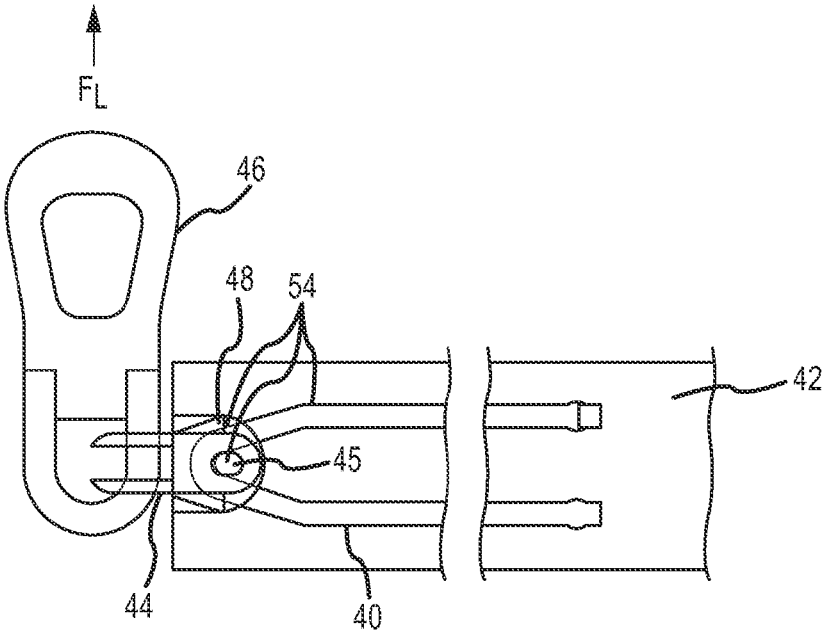
FIG. 3 is side elevation view of a hoisting assembly according to one embodiment.

FIG. 3 is a cross-sectional side elevation view of one embodiment of the present disclosure wherein an anchor 40 comprising legs is disclosed within a portion of a precast panel 42. Although features and methods of the present disclosure generally relate to precast concrete panels, it will be expressly recognized that the present disclosure and inventions contained herein are not so limited. Indeed, features and methods of the present disclosure may be provided for use and/or used with various objects requiring manipulation, such as manipulation with a lifting clutch and various features disclosed herein.

As shown, an anchor 40 is provided generally embedded in a panel 42 and capable of transmitting and maintaining a force at least as great as the weight of the panel 42 via additional components. FIG. 3 provides an anchor 40 in communication with a doughnut 44 or lifting shackle feature, further connected to a clutch bail 46 and a clutch bolt. Connection of the bail 46, lifting shackle 44, and clutch bolt is optional and removal of the same from the anchor 40 may be accomplished as shown and described herein. A direction of lift $F_L$ is generally depicted in FIG. 3, wherein the direction of lift $F_L$ is substantially perpendicular to the panel 42, such as where the panel 42 is being lifted or elevated from a flat or lay-down position. A wing feature 48 is provided with the shackle 44 as will be shown and described herein in more detail.

Figure 4:
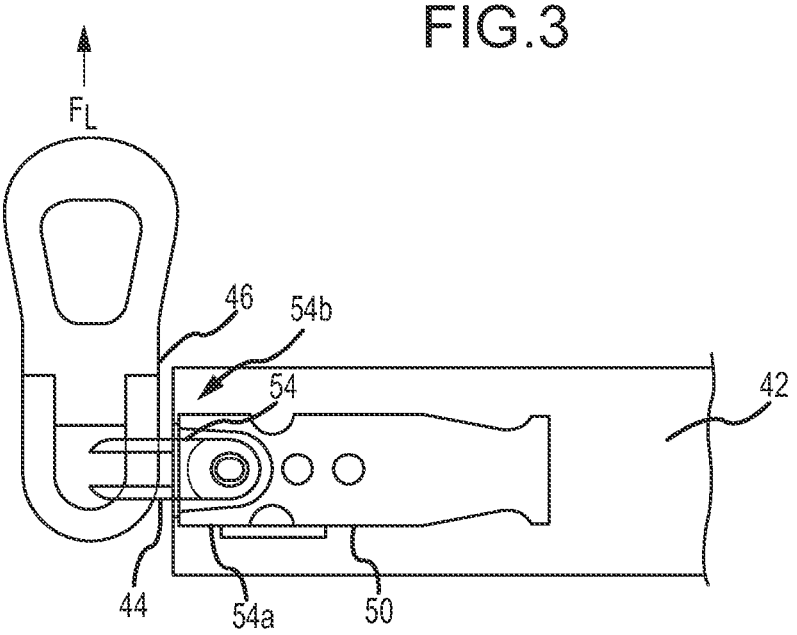
FIG. 4 is side elevation view of a hoisting assembly according to one embodiment.

FIG. 4 provides a partial cross-sectional view of an alternative embodiment of the present disclosure wherein a shackle 44 and an anchor 50 of a second construction is provided. The shackle 44 or doughnut of FIG. 4 comprises at least one bearing point 52 for contacting one or more ear members 54*a*, 54*b* of the anchor.

FIGS. 3-4 depict a bale member 46 disposed substantially perpendicular to a planar portion of the panel 42. Such an arrangement is provided where, for example, the panel 42 is disposed in a horizontal position prior to erection. A vertical lift force $F_L$ is provided to the bale 46 and transmitted to the panel 42 by system components to raise, erect, or lift the panel 42. In such operations, an initial lifting force will transmit a substantially transverse force to the panel 42. Contact between system elements (e.g. shackle 44) and the panel 42 and associated damage resulting therefrom is eliminated or reduced by the provision of load bearing points 54*a*, 54*b* as contemplated by the present disclosure. As shown in FIG. 3, the shackle 44 will be prevented from contacting the panel 42 based on force-transmitting communication between the peripheral wing(s) 48 of the shackle 44 and the anchor member 40, 50. The peripheral wings 48 define an internal arcuate surface generally corresponding to an outer radius of a curved anchor member 50. Thus, when the lift force $F_L$ of FIG. 3 is applied, forces are transmitted to the anchor 40 through the anchor bolt 45 and the internal arcuate member rather than directly to the panel 42. In the embodiment depicted in FIG. 4, a similar lift force $F_L$ is transmitted to the anchor 50 and isolated from the panel member 42 at least in part due to interaction between the bearing points of the shackle 44 and the ears 54*a*, 54*b* of the anchor member 50.

Figure 5:
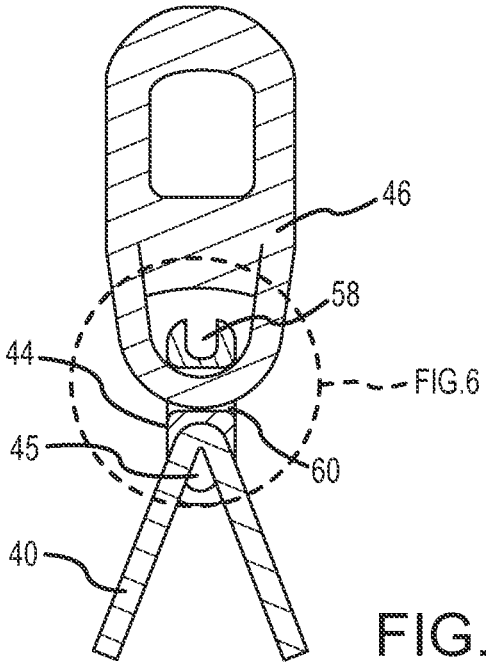
FIG. 5 is a cross-sectional side elevation view of a hoisting assembly according to one embodiment.

FIG. 5 is a cross-sectional view of an embodiment of the present disclosure comprising a bail 46, a lifting shackle 44 or ring clutch, a clutch bolt 45, and an anchor 40 in force transmitting communication with one another. In various embodiments, the bail 46 and lifting shackle 44 are securely interconnected in a permanent fashion. Selective attachment and removal of the bail-shackle combination to an anchor member 40 and associated panel is achieved through activation of the clutch bolt 45.

Figure 6:
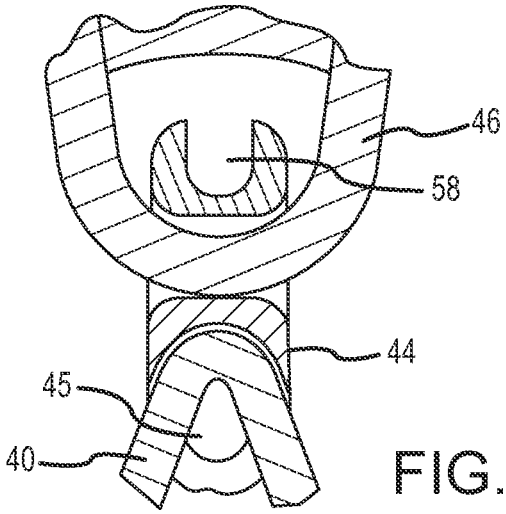
FIG. 6 is a detailed cross-sectional side elevation view of a hoisting assembly according to one embodiment.

FIG. 6 is a detailed view of Detail A of FIG. 5, further illustrating the communication between the bail 46, lifting shackle 44, clutch bolt 45, and anchor member 40. The bail 46 is preferably permanently secured to the lifting shackle 44, such as through threading a connection portion of the bail 46 through an eyelet 60 or center aperture of the shackle and securing loose ends by bending and/or welding appropriate components. A portion of the shackle 44 generally located external to a panel comprises a channel member or slot 58, the channel member 58 provided for allowing generally unrestricted travel of clutch bolt 45 for engaging and disengaging the bail 46 and shackle 44 from the anchor 40.

Figure 7:
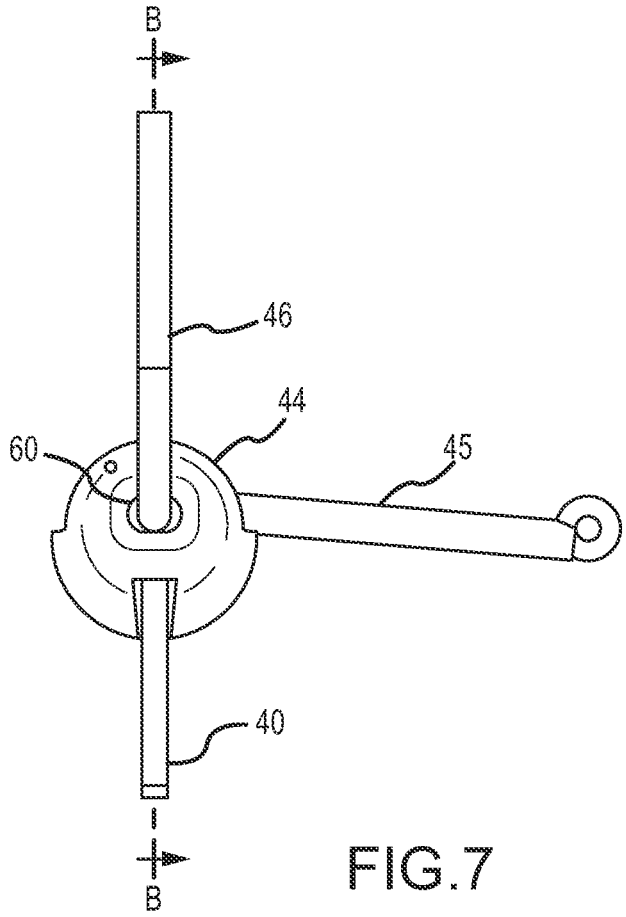
FIG. 7 is a side elevation view of a hoisting assembly according to one embodiment.

A side view of the cross-sectional views of FIGS. 5-6 is provided in FIG. 7. FIG. 7 depicts the bail 46 and shackle 44 members in operative force-transmitting communication with the anchor member 40. Communication between these components is achieved, at least in part, by a locking bolt 45 having an arcuate configuration on a first end. The arcuate locking bolt 45 extends away from the shackle 44 a sufficient distance to provide for leverage necessary to over various forces, including friction forces within the shackle member 44. The arcuate locking bolt 45 extends into the shackle 44 in a generally arcuate manner and, in the engaged position shown in FIG. 7, passes through the anchor member 40, thus placing the bail 46, lifting shackle 44, and anchor member 40 and associated panel in force-transmitting communication such that the combined system can be erected and/or moved by applying a force to the bail 46. The shackle member 44, as shown in FIG. 7, comprises a generally C-shaped member such that the lifting shackle 44 may be placed around an anchor member 40. To engage the anchor member 40, the locking bolt 45 with an arcuate configuration on a first end is subsequently rotated into place to secure the system in substantially the arrangement shown in FIG. 7. To release the bail 46, shackle 44, and locking bolt 45 from the anchor 40 and panel, the locking bolt 45 is rotated upwards (with respect to FIG. 7) until the arcuate portion of the locking bolt 45 is no longer disposed within or through the anchor 40.

Figure 8:
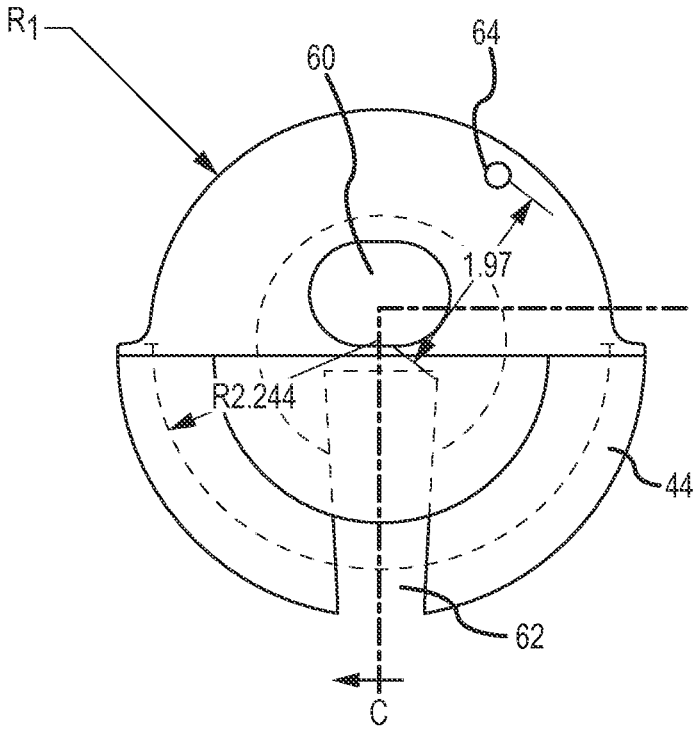
FIG. 8 is a cross-sectional side elevation view of a feature of a hoisting assembly according to one embodiment.
Figure 9:
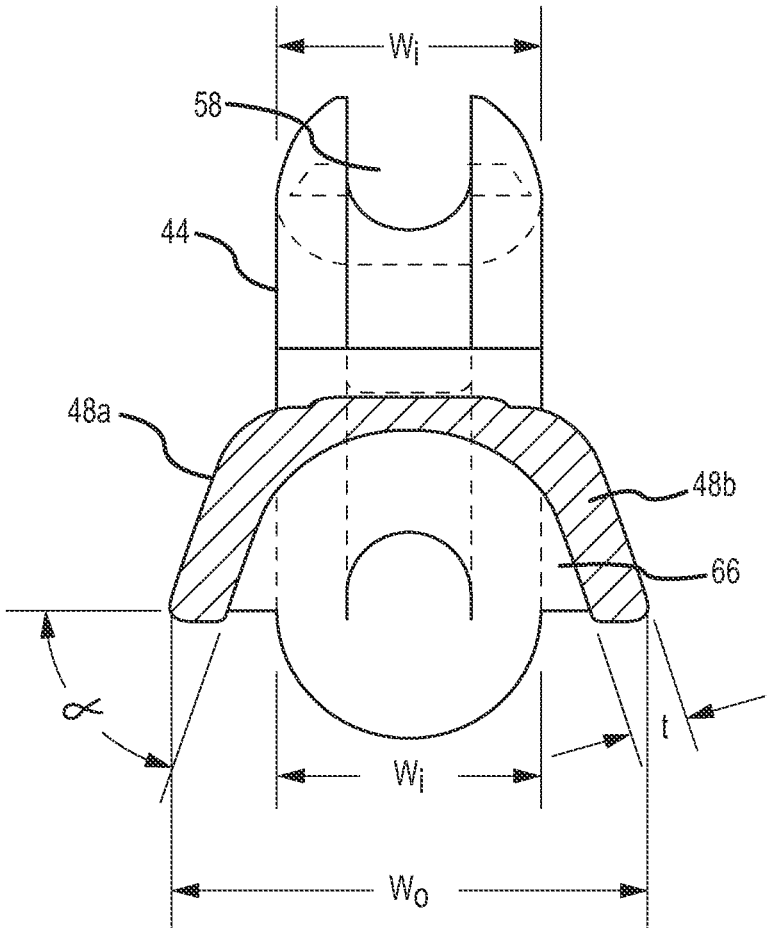
FIG. 9 is a cross-sectional elevation view of a feature of a hoisting assembly according to the embodiment of FIG. 8.
Figure 10:
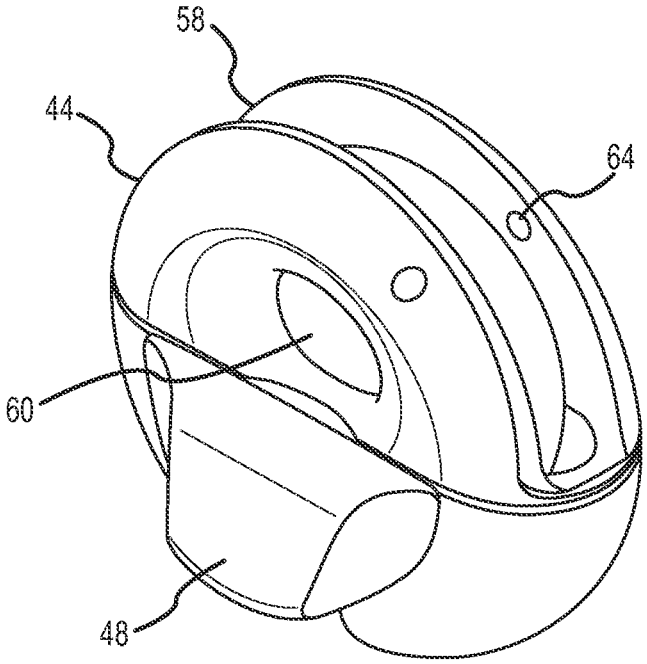
FIG. 10 is a perspective view of a feature of a hoisting assembly according to the embodiment of FIG. 8.

FIGS. 8-10 provide various views of a lifting shackle 44 according to one embodiment of the present disclosure. Various dimensions are provided to illustrate one exemplary embodiment, and it is expressly contemplated that dimensions may be varied in lifting shackles that still comport with the scope and spirit of the present disclosure.

Figure 11:
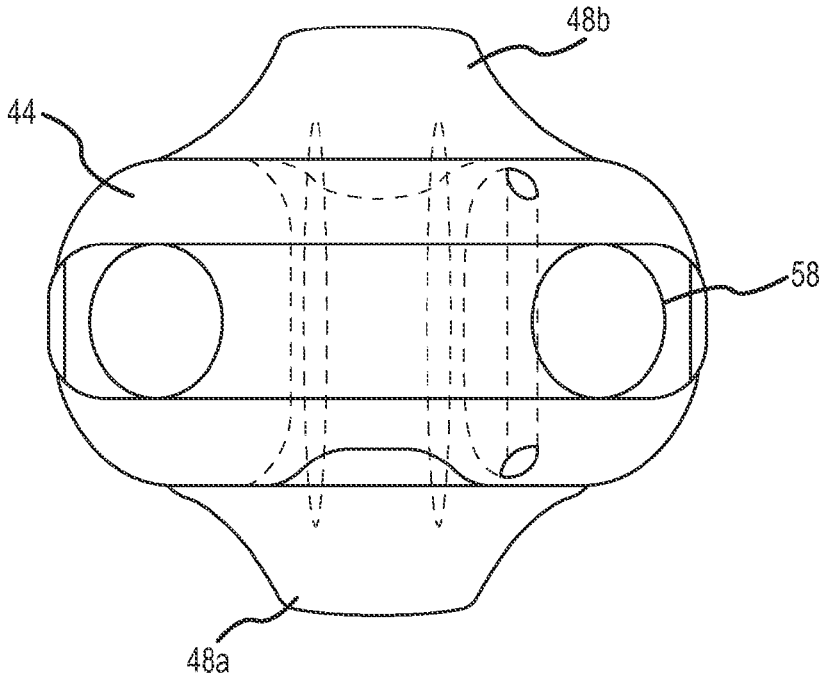
FIG. 11 is a top plan view of a feature of a hoisting assembly according to the embodiment of FIG. 8.

The shackle of FIGS. 8-10 depict a shackle 44 comprising void 62 for placing the shackle 44 around an installed anchor (not shown in FIG. 8), an anchor engagement slot 58 for receiving a locking bolt, and a lifting aperture 60 for receiving a tension bearing or applying member (not shown). Additionally, as shown in FIGS. 10-11, a lifting shackle 44 according to the present disclosure comprises peripheral wing members 48*a*, 48*b* extending laterally from the shackle 44. Peripheral wing members 48*a*, 48*b* form an internal curved surface 66 for contacting an anchor and further supporting the shackle during various lifting operations.

As shown in FIG. 8, an outer portion of the shackle 44 comprises a first radius $R_1$. In various embodiments, $R_1$ comprises a radius between approximately 1 and 5 inches. In preferred embodiments, $R_1$ comprises a radius of between approximately 2 and 3 inches. In one embodiment, $R_1$ comprises a radius of approximately 2.244 inches. An aperture 64 is provided. The aperture 64 is provided between approximately 1 and 3 inches from a center of the shackle 44. In preferred embodiments, the aperture 64 is provided between approximately 1.5 and 2.5 inches from a center of the shackle 44. In one embodiment, the aperture is provided approximately 1.97 inches from a center of the shackle.

As shown in FIG. 9, peripheral wings or extensions 48*a*, 48*b* are provided at an angle $\alpha$ with respect to a horizontal axis. In various embodiments, $\alpha$ comprises an angle of between approximately 60 and 85 degrees from horizontal. In preferred embodiments, $\alpha$ comprises an angle of between approximately 65 and 75 degrees from horizontal. In a preferred embodiment, $\alpha$ comprises and angle of approximately 72 degrees from horizontal. The peripheral extension members 48*a*, 48*b* comprise a thickness t of between approximately 0.250 and 0.500 inches. In a preferred embodiment, thickness t is approximately 0.390 inches. The peripheral extension members 48*a*, 48*b* comprise a height h. In various embodiments, height h comprises a height of between approximately 1.00 and 3.00 inches. In preferred embodiments, height h comprises a height of between approximately 1.50 and 1.75 inches. In one embodiment, height h comprises a height of approximately 1.608 inches. The shackle 44 comprises an internal width $w_i$. Internal width $w_i$ comprises a width of between approximately 1 and 3 inches. In preferred embodiments, internal width $w_i$ comprises a width of between approximately 1.5 and 2.0 inches. In one embodiment, internal width $w_i$ comprises a width of approximately 1.842 inches. The shackle 44 comprises an outer width $w_o$. Outer width $w_o$ comprises a width of between approximately 2 and 5 inches. In preferred embodiments, outer width $w_o$ comprises a width of between approximately 3.0 and 3.5 inches. In one embodiment, outer width $w_o$ comprises a width of approximately 3.290 inches.

In various embodiments, and as shown in FIG. 8, a through hole 64 or aperture comprising bolt securing means is provided in the shackle 44. Such an aperture 64 may receive a pin, such as a cotter pin or a clevis to aid in securing the attachment between the bolt, the shackle, and associated features.

As will be recognized by one of skill in the art, when a vertical load is applied to a clutch system and lifting anchor in a substantially vertical manner where system components are aligned, a minimal amount of lateral or excess movement will be present. That is, risk of contact between system components and the preformed concrete panel is minimized and spalling of the concrete is unlikely. It is known, however, that where loads are applied at angles or not perfectly-vertical, as is common in erection procedures, contact between lifting features and the concrete panel is known to occur with prior art systems. Such contact causes spalling damage to the concrete as well as various undesired point-loading. Peripheral wings 48*a*, 48*b* as shown and described herein provide an internal surface and support structure for contacting an erection anchor when a lateral movement or load is applied to the clutch system. An internal surface 66 of the peripheral wings 48*a*, 48*b* contacts an exterior surface of the erection anchor upon application of a lateral or non-vertical load, thus maintaining the clutch 44 in a substantially aligned position with respect to a panel or member to be lifted. Maintaining the clutch 44 in such a position prevents contact between various lifting elements and the panel member. Whereas known devices typically result in various forces and points of contact between, for example, an edge region of a pre-formed void, peripheral wings and internal surface area of the shackle center the lifting device and act to direct various loads to the anchor.

As shown in FIGS. 10-11, peripheral wings 48*a*, 48*b* comprise substantially symmetrical laterally extending members or lateral protrusions. It will be expressly recognized, however, that the exterior appearance of the wings 48*a* 48*b* may vary widely within the scope and spirit of the present disclosure. Features of the present disclosure prevent various movement(s) of system elements by providing a desired internal dimension of the shackle generally corresponding to and/or slightly larger than a corresponding outer dimension of the anchor. FIG. 11 provides a top plan view of one embodiment of a shackle 44 comprising anchor pin receiving slot 58 and peripheral wings or extensions 48*a*, 48*b*. As discussed, an underside of the peripheral wings 48*a*, 48*b* comprise an internal arcuate surface disposed substantially perpendicular to the arcuate surface or feature defined by the slot 58. A first arcuate surface within slot 58 is provided for receiving an arcuate portion of an anchor bolt. A second arcuate surface provided within peripheral wings 48*a*, 48*b* and shackle 44 is provided for receiving an at least partially arcuate portion of an anchor.

Figure 12:
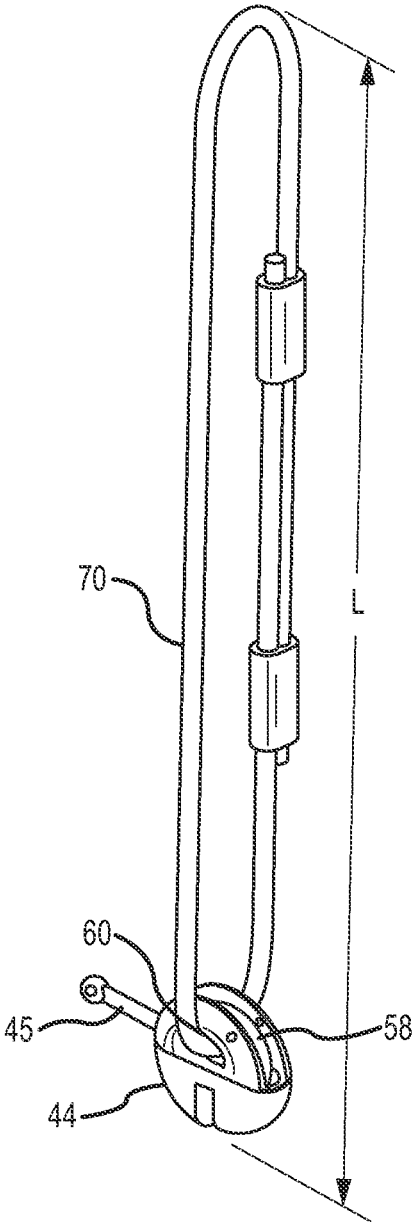
FIG. 12 is a perspective view of a hoisting assembly according to one embodiment.

FIG. 12 depicts another embodiment wherein a cable 70 is provided in force-transmitting communication with a shackle 44. The cable may be provided, for example, in lieu of a lifting bale or other similar feature. The cable 70 is looped into a length L and threaded through the aperture 60 of the shackle 44. A locking bolt with an arcuate configuration on a first end 45 is provided and rotatable through a slot 58 for securing the shackle 44 and associated cable 70 to an anchor, such as an anchor embedded in a precast panel.

While various embodiments of the present invention have been described in detail, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. In addition, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A hoisting assembly adapted for lifting a precast concrete element which has at least one anchoring member embedded therein, the assembly comprising:

a locking bolt with an arcuate configuration on a first end;

a hoisting shackle having a toroidal portion, the toroidal portion comprising a slot positioned on at least an outer circumference of the toroidal portion for receiving the first end of the locking bolt;

said hoisting shackle further comprising laterally extending members defining a void portion having an internal arcuate surface, the internal arcuate surface oriented substantially perpendicular to the slot, and the internal arcuate surface adapted for contacting the anchoring member, wherein the hoisting shackle and the anchoring member are provided in force transmitting communication when the first end of the locking bolt is received by the slot and the anchoring member.

2. The hoisting assembly of claim 1, wherein the radius substantially corresponds to a radius of the anchoring member.

3. The hoisting assembly of claim 1, further comprising an anchor member having a first leg comprising a first length and a second leg comprising a second length, the first leg disposed substantially parallel to the second leg, and the first and second legs joined together by a union at one end, the union having a predetermined radius.

4. The hoisting assembly of claim 3, wherein the first length and the second length are substantially equivalent.

5. The hoisting assembly of claim 1, wherein the laterally extending members comprise peripheral wings defining an outer surface of the internal arcuate surface.

6. The hoisting assembly of claim 1, further comprising an anchoring member having two substantially parallel members for extending into a concrete member, each of the two substantially parallel members connected at a first end to an inwardly converging member, the inwardly converging members connected at a load point.

7. The hoisting assembly of claim 6, wherein each of the substantially parallel members comprise an outwardly oriented portion at a second end of the substantially parallel members, the outwardly oriented members being angled with respect to a longitudinal axis of the substantially parallel members by approximately ninety degrees and wherein the outwardly oriented members extend away from each other.

8. A hoisting assembly adapted for erecting a precast concrete element which has at least one anchoring member embedded therein, the assembly comprising:

a hoisting shackle having a hollow toroidal portion, the hollow toroidal portion comprising a slot proximal at least an outer circumference of the hollow toroidal portion for receiving a locking bolt with an arcuate configuration on a first end;

the hoisting shackle comprising peripheral extensions forming a void portion for receiving an anchoring member and at least one bearing point, the bearing point comprising a width greater than a width of a remainder of the toroidal portion and the bearing point adapted for contacting the anchoring member.

9. The hoisting assembly of claim 8, wherein the peripheral extensions form an area of increased thickness to prevent lateral movement of the hoisting shackle.

10. The hoisting assembly of claim 9, wherein an internal arcuate surface of the void portion comprises a radius that is substantially the same as a radius of the anchoring member.

11. The hoisting assembly of claim 8, further comprising an anchor member having a first leg comprising a first length and a second leg comprising a second length, the first leg disposed substantially parallel to the second leg, and the first and second legs joined together by a union at one end, the union having a predetermined radius.

12. The hoisting assembly of claim 11, wherein the first length and the second length are substantially equivalent.

13. The hoisting assembly of claim 11, wherein the anchoring member comprises two substantially parallel members for extending into a concrete member, each of the two substantially parallel members connected at a first end to an inwardly converging member, the inwardly converging members connected at a load point.

14. The hoisting shackle of claim 11, wherein each of the substantially parallel members comprise an outwardly oriented portion at a second end of the substantially parallel members, the outwardly oriented members being angled with respect to a longitudinal axis of the substantially parallel members by approximately ninety degrees and wherein the outwardly oriented members extend away from each other.

15. A hoisting assembly adapted for lifting a precast concrete element which has at least one anchoring member embedded therein, the assembly comprising:

a hoisting shackle having a toroidal portion and an outer circumference;

at least a portion of the outer circumference comprising a recess for receiving a locking bolt with an arcuate configuration on a first end;

the hoisting shackle further comprising a void portion for receiving an anchoring member;

a lateral protrusion extending outwardly from the toroidal portion, the lateral protrusion at least partially defining an internal arcuate surface provided substantially perpendicular to the outer circumference of the toroidal portion, and the internal arcuate surface adapted for contacting an anchoring member.

16. The hoisting assembly of claim 15, wherein the locking bolt comprises a substantially linear portion and an arcuate portion.

17. The hoisting assembly of claim 15, wherein the internal arcuate surface comprises an arcuate surface with a radius that is substantially identical to a radius of a portion of the anchoring member.

18. The hoisting assembly of claim 15, further comprising an anchor member having a first leg comprising a first length and a second leg comprising a second length, the first leg disposed substantially parallel to the second leg, and the first and second legs joined together by a union at one end, the union having a predetermined radius.

19. The hoisting assembly of claim 15, wherein the hoisting shackle comprises first and second lateral protrusions, the lateral protrusions defining an outer surface of the internal arcuate surface.

* * * * *